US006339630B1

(12) United States Patent
Hartley

(10) Patent No.: US 6,339,630 B1
(45) Date of Patent: Jan. 15, 2002

(54) SEALED DRIVE SCREW OPERATOR

(75) Inventor: Michael S. Hartley, Suffolk, VA (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 09/572,842

(22) Filed: May 18, 2000

(51) Int. Cl.[7] ..... B65B 7/28

(52) U.S. Cl. ..... 376/272; 220/560.1; 220/23.89; 220/328; 220/DIG. 20; 220/200; 376/277; 292/43; 292/33; 292/155; 250/506.1; 250/507.1; 70/443; 70/184; 70/179; 206/1.5

(58) Field of Search ..... 292/433, 33, 155, 292/317; 220/560.1, 23.89, 328, DIG. 20; 376/272, 277; 588/900; 464/170, 52; 250/506.1, 507.1; 29/898.054, 898.041; 70/443, 448, 184, 179; 206/1.5

(56) References Cited

U.S. PATENT DOCUMENTS

| | | | | | |
|---|---|---|---|---|---|
| 1,560,489 | A | * | 11/1925 | Yager et al. | |
| 2,235,684 | A | * | 3/1941 | Hornschurch | |
| 2,305,589 | A | * | 12/1942 | Stark et al. | |
| 2,797,948 | A | * | 7/1957 | Tangard | |
| 3,710,121 | A | * | 1/1973 | Bedrosian | 250/108 R |
| 3,886,368 | A | * | 5/1975 | Rollins et al. | 250/507 |
| 4,055,274 | A | * | 10/1977 | Waldenmeier | 220/256 |
| 4,122,969 | A | * | 10/1978 | Hugley | 220/256 |
| 4,139,118 | A | * | 2/1979 | Parker | 220/316 |
| 4,356,062 | A | * | 10/1982 | Bosshard | 376/272 |
| 4,456,827 | A | | 6/1984 | Botzem et al. | |
| 4,465,201 | A | * | 8/1984 | Chalfant, Jr. | 220/3 |
| 4,576,779 | A | | 3/1986 | McWilliam et al. | |
| 4,636,645 | A | | 1/1987 | Kessinger | |
| 4,643,328 | A | * | 2/1987 | Lorenzelli et al. | 220/256 |
| 4,693,278 | A | * | 9/1987 | Wilson et al. | 138/89 |
| 4,874,573 | A | * | 10/1989 | Wood et al. | 376/272 |
| 4,883,637 | A | * | 11/1989 | McDaniels, Jr. | 376/272 |
| 4,893,022 | A | | 1/1990 | Hall et al. | |
| 4,983,352 | A | | 1/1991 | Efferding | |
| 5,064,575 | A | * | 11/1991 | Madle et al. | 252/633 |
| 5,119,956 | A | * | 6/1992 | Cioletti | 220/327 |
| 5,372,373 | A | * | 12/1994 | Reel | 280/96.1 |
| H11 | H | | 1/1986 | Basnar et al. | |
| H10 | H | | 1/1986 | Frank et al. | |

FOREIGN PATENT DOCUMENTS

| | | | | |
|---|---|---|---|---|
| GB | 1324015 | * | 7/1973 | G21F/5/00 |

* cited by examiner

*Primary Examiner*—Peter M. Poon
*Assistant Examiner*—Andrea M. Valenti
(74) *Attorney, Agent, or Firm*—Virginia B. Caress; Paul A. Gottlieb

(57) ABSTRACT

A sealed operator is provided for operating an internal locking control element for a closure head for the inner container in a dual container hazardous waste storage system. The operator includes a cylindrical housing in which a bushing/operator element assembly is mounted for translational movement. The latter assembly includes a cylindrical bushing sealingly mounted in the housing, a spherical bearing assembly including an annular outer bearing press fit within the bushing and an annular inner bearing. An operator element is press fit within the inner surface of the inner bearing. The operator element includes a driving head which engages the locking control element for the closure head of the inner container.

21 Claims, 1 Drawing Sheet

SEALED DRIVE SCREW OPERATOR

BACKGROUND OF THE INVENTION

1. Field of the Invention

The present invention relates to a sealed screw operator for operating wedge drive screws or the like without breaching a hazardous material control border.

2. Related Art

Although the invention is not limited to such an application, the invention is particularly useful as applied to dual cask arrangements wherein an inner container or cask is installed inside of an outer shipping cask. In such arrangements, the inner container or cask is adapted to be removed from the shipping cask in instances where the exterior of the cask is contaminated with a hazardous material or materials. Loading and/or unloading operations may take place in a dry, non-hazardous environment and, under these circumstances, the inner container is not removed from the shipping cask. The inner cask includes a closure head which is secured by a series of wedge blocks operated by drive screws in the inner container walls. Because the inner container is not removed from the shipping cask, access to the drive screws during security of the closure head must be obtained through the wall of the shipping cask. It will be appreciated that, during operations, the goal is to avoid breaching boundaries contaminated with hazardous materials.

Patents of interest in this field include: U.S. Pat. No. 4,893,022 (Hall, et al.) which discloses an improved closure for covering and sealing a single cask radioactive waste system using sealing bolts. The sealing bolts are inserted through a bore having a shoulder to prevent the sealing bolts from inadvertently falling through the bore and breaking the seal. U.S. Pat. No. 4,456,827 (Botzem, et al.) discloses a transportation and storage container for radioactive wastes which are socketed screws in tapped sockets to seal the container from the admission of water. U.S. Pat. No. 4,636,645 (Kessinger) discloses a closure system for a storage cask for spent nuclear fuel which can be temporarily closed with a shear key and permanently closed via welding. U.S. Pat. No. 4,983,352 (Efferding) discloses a closure system for storing spent nuclear fuel. Studs are coated with sealant before screwing the studs into bores. U.S. Pat. No. 4,576,779 (McWilliams) discloses a wedge shaped member which is used to close the end of a transport flask and which advances a seal plate to close an opening in the base of the flask. U.S. Statutory Invention Registration No. HII (Basnar et al.) and U.S. Statutory Invention Registration No. HIO (Frank, et al.) both disclose a can-out hatch assembly. In both, an actuating shaft is inserted through a bore in a container for the purpose of positioning a hex head coupling against a pressure plate. The actuating shaft and the bore are provided with complimentary threads.

SUMMARY OF THE INVENTION

According to the invention, there is provided a sealed operator for operating (e.g., engaging and locking) a controllable element (e.g., a wedge screw drive such as disclosed above) in a dual container hazardous waste storage system.

In accordance with one aspect of the invention, there is provided, for use in a dual container hazardous waste containment system comprising an inner container, an outer container and an internal locking control element disposed inwardly of the outer container (such as the wedge screw drive element described above), a sealed operator device for operating the locking control element and adapted to be mounted in an aperture in the outer container, said operator comprising: a housing adapted to be sealingly mounted in said aperture, a bushing sealingly mounted within said housing for longitudinal movement with respect to said housing; a bearing assembly sealingly mounted within said bushing and comprising an outer bearing secured within said bushing and an inner bearing pivotably movable with respect to said outer bearing; and an operator element sealingly mounted within said inner bearing for movement therewith, said operator element including a stem portion secured within said inner bearing and a driving head adapted to engage the locking control element.

Preferably, the inner and outer bearings form a spherical bearing assembly. The bearings advantageously include respective polymer coated bearing surfaces.

In a preferred implementation, the outer bearing is a press fit within the bushing and the stem portion of the operator element is a press fit within the inner bearing. Advantageously, the outer surface of the housing is threaded for mounting in the aperture in the outer container.

In accordance with a further feature of importance, the bushing has an outer cylindrical surface including longitudinally extending guide track therein and the housing includes an inwardly extending guide pin received in the guide track for limiting angular movement of the bushing.

Preferably, at least one o-ring seal is provided between said bushing and said housing. More preferably, at least first and second o-rings are mounted in annular grooves in an outer cylindrical surface of the bushing.

In accordance with a further aspect of the invention a dual container hazardous waste containment system is provided which comprises an inner container, an outer container, a controllable element (e.g., the aforementioned wedge drive element) associated with the inner container and disposed inwardly of the outer container and a sealed operator device mounted in an aperture in the outer container for operating the controllable element, the sealed operator comprising: a housing sealingly mounted in the aperture; a bushing sealingly mounted within the housing for longitudinal movement with respect to the housing; a bearing assembly mounted within the bushing and comprising an outer bearing press fit within the bushing and an inner bearing pivotably movable with respect to the outer bearing; and an operator element mounted within the inner bearing for movement therewith, said operator element including a stem portion press fit within the inner bearing and a driving head adapted to engage the controllable element.

Further features and advantages of the present invention will be set forth in, or apparent from, the detailed description of preferred embodiments thereof which follows.

DESCRIPTION OF THE PREFERRED EMBODIMENTS

Figure 1:
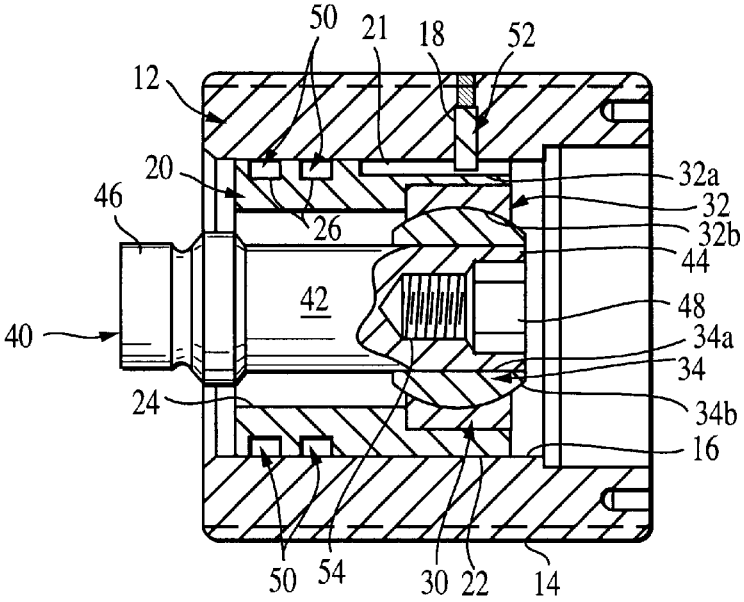
FIG. 1 shows a side view of a sealed operator in accordance with a preferred embodiment of the invention.

Referring to FIG. 1, there is shown a sealed operator, generally denoted 10, constructed in accordance with a preferred embodiment of the invention. The sealed operator 10 includes, inter alia, the following elements or components described in more detail below: a cylindrical or tubular housing 12, a tubular bushing 20 mounted in housing 12, a bearing assembly 30 press fit to and supported by bushing 20, an operator element 40 press fit to and supported by bearing assembly 30, a pair of o-rings 50 providing a seal between the bushing 20 and the housing 12, and a guide pin 52 affixed to housing 12 for controlling the rotational movement of bushing 20 during rotation of operator element 40.

Figure 2:
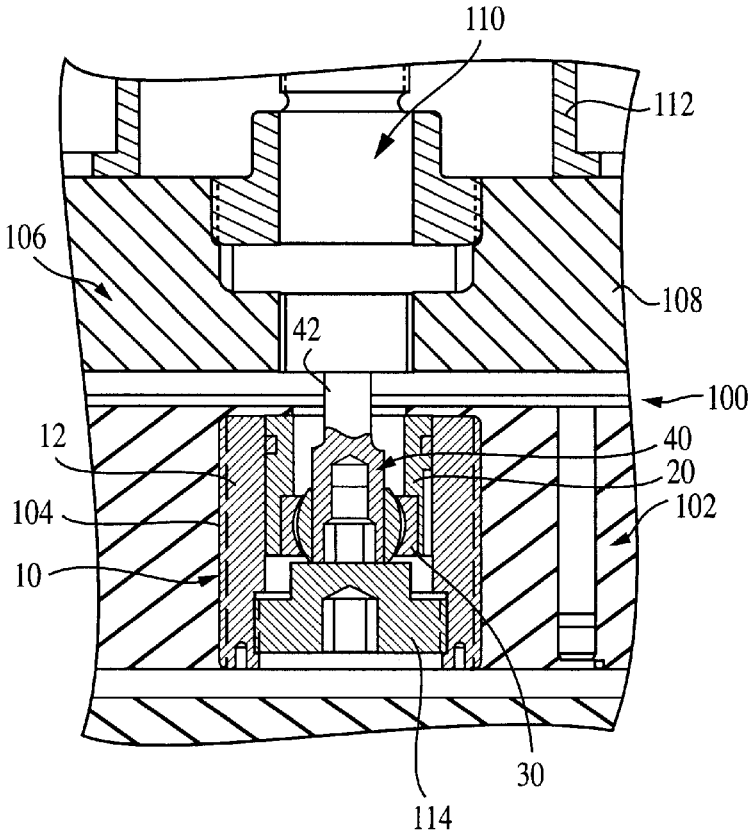
FIG. 2 shows a side view of a dual container system incorporating the sealed operator of FIG. 1.

The sealed operator 10 is, in use, incorporated in a dual container hazardous waste system such as that shown in FIG. 2 and denoted 100 in that figure. The container system 100 includes an outer container or shipping cask 102 having an aperture or recess 104 therein in which the sealed operator 10 is housed, and an inner container 106. The inner container 106 includes a wedge drive screw support element 108 which supports a wedge drive screw 110 for a wedge block (not shown) corresponding to that described above. A sleeve 112 is provided to guide the movement of the associated wedge. As indicated above, the wedge block is one of a plurality of wedge blocks used to secure in place a closure head (not shown) for the inner cask 106. It will be understood that the wedge and wedge drive assembly are conventional and thus will not be further described.

Referring again to FIG. 1, and considering the specific components of the sealed operator 10 in more detail, the housing 12 includes an outer surface 14, an inner surface 16, and a hole or opening 18 in which guide pin 52 is affixed. As shown in FIG. 2, the tubular housing 12 is inserted into the aperture 104, so that the outer surface 14 frictionally engages the wall defining aperture 104. In a preferred embodiment, the outer surface 14 of the tubular housing 12 is threaded and the aperture 104 has an opposing abutment surface for receiving the threads of the tubular housing 12. Thread sealant is preferably applied to the opposing abutment surface or to the outer surface 14 of the housing 12 or to both. All components of the dual-container, operator assembly-system shown in FIGS. 1 and 2 are manufactured from materials selected for corrosion resistance and compatibility with the other materials. In the preferred embodiment, the housing 12 is manufactured from aluminum bronze.

The cylindrical or tubular bushing 20 includes an outer surface 22, an inner surface 24, and a plurality of annular grooves 26 in outer surface 22 in which o-rings 50 are received. The outer diameter of bushing 20 is smaller than the inner diameter of housing 12 so that bushing 20 can be inserted into and translate within the tubular housing 12. In the preferred embodiment, the tubular bushing 20 is manufactured from stainless steel, e.g., NITRONIC 60, a trademark of Armco Steel. Stainless steel has good compatibility with the aluminum bronze and does not cause galling during the sliding contact associated with the engagement/disengagement of the operator described below.

As indicated above, bushing 20 has a plurality of annular grooves 26 (two are shown) which receive a like plurality of o-rings 50 so as to enhance sealing between the outer surface 22 of the bushing 20 and the inner surface 16 of the housing 12.

Bushing 20 also includes a longitudinally extending guide track 21 located in an upper portion of outer surface 22. The aforementioned guide pin 52, which is affixed in the opening 18 in the housing 12, engages in track 21 so as to prevent rotation of the bushing 20, i.e., to limit the movement of bushing 20 to a translating movement. This feature prevents potential damage to the o-rings 50 due to "wrapping up" during operation.

The bearing assembly 30 includes an outer bearing 32 including an outer cylindrical surface 32*a* and an inner concave, part spherical bearing race 32*b*, and inner bearing 34 including an outer convex, part spherical bearing surface 34*b* and an inner cylindrical surface 34*a*. The overall bearing assembly 30 is press fit into a cylindrical recessed portion of bushing 20 with the outer surface 32*a* of the bearing 32 engaging the associated mating surface of bushing 20. The mating part spherical surfaces 32*b* and 34*b* of bearings 32 and 34 permit a limited pivoting movement so that operator element 40 can still engage the wedge drive screw 110 where there is misalignment between the wedge drive screw 110 and the operator element 40. In a preferred embodiment, the pivoting movement provided will accommodate an angle of approximately seven to eight degrees between drive screw 110 and the operator element 40 which is equivalent to an offset between the inner container 106 and the outer container or shipping case 102 of approximately 0.2 inches.

The bearings 32 and 34 fit together sufficiently closely to provide sealing of the bearing assembly 30 under typical operating conditions. In addition, bearing assembly 30 preferably includes a polymer coating which increases its effectiveness as a seal. If there is a likelihood of a flood of hazardous material, a sealed bearing assembly can be used as bearing assembly 30. The press fit between bearing assembly 30 and bushing 20 and operator element 40 provides effective sealing between the corresponding interfaces.

The operator element 40 has a stem 42 interconnecting a driven end 44 and a driving head 46. The operator element 40 is a press fit in bearing 34 with the outer surface of stem 42 engages the cylindrical inner surface 34*a* of bearing 34. The driving head 46 is adapted to engage the wedge drive screw 110 discussed above in connection with FIG. 2. In a preferred embodiment, a hex-head driving head 46 is employed, but, in general, any shape is appropriate as long as the head 46 properly couples with the driven end of the wedge drive screw 110. In the preferred embodiment, the flats of the hex-head driving head 46 are radiused to avoid binding where, for example, the inner container 106 is misaligned with respect to the outer container 102 during shipping. The driven end 44 of the operator element 40 includes an opening 48 adapted to receive an appropriate tool for driving the operator element 40. The driven end 44 of the operator element 40 also includes a threaded opening 54 adapted to receive a tool (not shown) for translating the bushing 20 outwardly within the housing 12.

In operation, the aforementioned driving tool (not shown) is coupled to opening 48 of the driven end 44 of the operator element 40 and pushed in so as to provide translation of the operator element 40 forwardly, i.e., to the left, as viewed in FIG. 1. The operator element 40 is translated and manipulated until the driving head 46 operator couples with wedge drive screw 110. The wedge drive screw 110 is rotated to drive the wedge in a leftward, horizontal direction, as viewed in FIG. 1. As indicated above, the wedge drive screw 110 drives a corresponding wedge block (not shown) to secure the closure head (not shown) of the inner cask or container 106. It is, of course, understood that the bearing assembly 30 and bushing 20 also translate with operator element 40 relative to housing 12.

During shipment, a plug 114 (see FIG. 2) is screwed Into the housing 12 and jammed against the operator element 40 to lock the assembly in place.

When removal of the inner container 106 from the shipping cask 102 is desired, a tool (not shown) is threaded into opening 54 permitting translation of bushing 20 in the outward direction (to the right in FIG. 1) to disengage the driving head 46 of operator 40 from the wedge drive screw 110.

Although the invention has been described above in relation to preferred embodiments thereof, it will be understood by those skilled in the art that variations and modifications can be effected in these preferred embodiments without departing from the scope and spirit of the invention.

What is claimed is:

1. For use in a dual container hazardous waste containment system comprising an inner container, an outer container and an internal locking control element disposed inwardly of the outer container, a sealed operator device for operating the locking control element and adapted to be mounted in an aperture in the outer container, said operator comprising:

a housing adapted to be sealingly mounted in said aperture;

a bushing sealingly mounted within said housing for longitudinal movement with respect to said housing;

a bearing assembly sealingly mounted within said bushing and comprising an outer bearing secured within said bushing and an inner bearing pivotably movable with respect to said outer bearing; and an operator element sealingly mounted within said inner bearing for movement therewith, said operator element including a stem portion secured within said inner bearing and a driving head adapted to engage the locking control element.

2. The operator device of claim 1 wherein said inner and outer bearings form a spherical bearing assembly.

3. The operator device of claim 2 wherein said bearings include respective polymer coated bearing surfaces.

4. The operator device of claim 1 wherein the outer bearing is a press fit within the bushing and the stem portion of the operator element is a press fit within the inner bearing.

5. The operator device of claim 1 wherein the outer surface of the housing is threaded for mounting in the aperture in the outer container.

6. The operator device of claim 1 wherein said bushing has an outer cylindrical surface including longitudinally extending guide track therein and said housing includes an inwardly extending guide pin received in said guide track for limiting angular movement of said bushing.

7. The operator device of claim 1 further comprising at least one o-ring seal between said bushing and said housing.

8. The operator device of claim 7 wherein at least one o-ring seal comprises first and second o-rings mounted in annular grooves in an outer cylindrical surface of said bushing.

9. A dual container hazardous waste containment system comprising an inner container, an outer container, a controllable element associated with the inner container and disposed inwardly of the outer container, and a sealed operator device mounted in an aperture in the outer container for operating the controllable element, the sealed operator comprising:

a housing sealingly mounted in said aperture;

a bushing sealingly mounted within said housing for longitudinal movement with respect to said housing;

a bearing assembly mounted within said bushing and comprising an outer bearing press fit within said bushing and an inner bearing pivotably movable with respect to said outer bearing; and an operator element mounted within said inner bearing for movement therewith, said operator element including a stem portion press fit within said inner bearing and a driving head adapted to engage the controllable element.

10. The dual container hazardous waste containment system of claim 9 wherein said inner and outer bearings form a spherical bearing assembly.

11. The dual container hazardous waste containment system of claim 10 wherein said bearings include respective polymer coated bearing surfaces.

12. The dual container hazardous waste containment system of claim 9 wherein the outer surface of the housing is threaded for mounting in the aperture in the outer container.

13. The dual container hazardous waste containment system of claim 9 wherein said housing has an outer cylindrical surface including longitudinally extending guide track therein and said housing includes an inwardly extending guide pin received in said guide track for limiting angular movement of said bushing.

14. The dual container hazardous waste containment system of claim 9 further comprising at least one o-ring seal between said bushing and said housing.

15. The dual container hazardous waste containment system of claim 14 wherein said at least one o-ring seal comprises first and second o-rings mounted in annular grooves in an outer cylindrical surface of said bushing.

16. A dual container hazardous waste containment system comprising an inner container, an outer container, a wedge drive element for securing in place a closure head for the inner container, and a sealed operator device mounted in an aperture in the outer container for operating said wedge drive element, the sealed operator comprising:

a cylindrical housing sealingly mounted in said aperture;

a cylindrical bushing sealingly mounted within said housing for longitudinal movement with respect to said housing;

a spherical bearing assembly mounted within said bushing and comprising an annular outer bearing press fit within said bushing and an annular inner bearing pivotably movable with respect to said outer bearing; and an operator element mounted within said inner bearing for movement therewith, said operator element including a stem portion press fit within said inner bearing and a driving head adapted to engage the wedge drive element.

17. The dual container hazardous waste containment system of claim 16 wherein said bearings include respective polymer coated bearing surfaces.

18. The dual container hazardous waste containment system of claim 17 wherein the outer surface of the housing is threaded for mounting in the aperture in the outer container.

19. The dual container hazardous waste containment system of claim 16 wherein said housing has an outer cylindrical surface including longitudinally extending guide track therein and said housing includes an inwardly extending guide pin received in said guide track for limiting angular movement of said bushing.

20. The dual container hazardous waste containment system of claim 16 further comprising at least one o-ring seal between said bushing and said housing.

21. The dual container hazardous waste containment system of claim 20 wherein said at least one o-ring seal comprises first and second o-rings mounted in annular grooves in an outer cylindrical surface of said bushing.

* * * * *